US006119081A

United States Patent [19]

Cho et al.

[11] Patent Number: 6,119,081

[45] Date of Patent: Sep. 12, 2000

[54] PITCH ESTIMATION METHOD FOR A LOW DELAY MULTIBAND EXCITATION VOCODER ALLOWING THE REMOVAL OF PITCH ERROR WITHOUT USING A PITCH TRACKING METHOD

[75] Inventors: Yong-duk Cho, Suwon; Moo-young Kim, Sungnam, both of Rep. of Korea

[73] Assignee: Samsung Electronics Co., Ltd., Suwon, Rep. of Korea

[21] Appl. No.: 09/148,777

[22] Filed: Sep. 4, 1998

[30] Foreign Application Priority Data

Jan. 13, 1998 [KR] Rep. of Korea ..... 98-697

[51] Int. Cl.[7] ..... G10L 21/00

[52] U.S. Cl. ..... 704/207; 704/205

[58] Field of Search ..... 704/207, 220, 704/223, 224

[56] References Cited

U.S. PATENT DOCUMENTS

| | | | |
|---|---|---|---|
| 5,195,166 | 3/1993 | Hardwick et al. | 704/201 |
| 5,216,747 | 6/1993 | Hardwick et al. . | |
| 5,226,084 | 7/1993 | Hardwick et al. | 704/222 |
| 5,226,108 | 7/1993 | Hardwick et al. | 704/201 |
| 5,247,579 | 9/1993 | Hardwick et al. | 704/220 |
| 5,473,727 | 12/1995 | Nishiguchi et al. | 704/222 |
| 5,517,511 | 5/1996 | Hardwick et al. | 704/201 |
| 5,574,823 | 11/1996 | Hassanein et al. | 704/208 |
| 5,581,656 | 12/1996 | Hardwick et al. | 704/258 |
| 5,754,974 | 5/1998 | Griffin et al. | 704/206 |

*Primary Examiner*—Krista Zele
*Assistant Examiner*—Michael N. Opsasnick
*Attorney, Agent, or Firm*—Burns, Doane, Swecker & Mathis, L.L.P.

[57] ABSTRACT

A of estimating a pitch in a multiband excitation vocoder is provided. The method includes the steps of (a) obtaining an error amount with respect to respective pitch candidates in a predetermined pitch area from an input voice magnitude spectrum, (b) obtaining a weighted function with respect to the respective pitch candidates, (c) obtaining a weighted error amount with respect to the respective pitch candidates, and (d) determining the candidate pitch having the minimum error amount in the weighted error amount with respect to the respective pitch candidates to be an estimated pitch. According to the present invention, in the vocoder of the multiband excitation method, it is possible to obtain high speech quality due to a short delay time since it is possible to remove a gross pitch error without using a pitch tracking method.

5 Claims, 6 Drawing Sheets

PITCH ESTIMATION METHOD FOR A LOW DELAY MULTIBAND EXCITATION VOCODER ALLOWING THE REMOVAL OF PITCH ERROR WITHOUT USING A PITCH TRACKING METHOD

BACKGROUND OF THE INVENTION

1. Field of the Invention

The present invention relates to a vocoder, and more particularly, to a pitch estimation method in a multiband excitation (MBE) vocoder.

2. Description of the Related Art

A vocoder, or voice encoder, is a device of compressing a voice signal in a communications network. Therefore, speech quality is considerably affected by the performance of the voice encoder.

The speech quality is determined by two elements. One is the restored tone quality of the voice encoder and the other is a delay time for restoring the tone quality. In particular, when the delay time for restoring the tone quality is long, speech is not smooth due to generation of echos. Therefore, a low-delay tone quality restoration is required in the voice encoder.

Recently, the MBE method is widely used as a voice encoder of a low transmission rate (in general, 1 through 4 kbit/s). The MBE method is widely known to reproduce high tone quality at a low transmission rate. However, with the exception of satellite communications, due to a long delay time it is difficult to use the MBE method for a terrestrial cellular network. The pitch estimation process causes the delay time to be long in the MBE method.

In general, in the process of estimating the pitch of the voice signal, two kinds of errors, i.e., a gross pitch error and a fine pitch error are considered. The gross pitch error is generated when the difference between an original pitch and an estimated pitch is considerably large. Such is the case when the estimated pitch doubles the original pitch (pitch doubling) or halves the original pitch (pitch halving). The fine pitch error is generated due to the restriction in the resolution.

In the conventional MBE vocoder, the problem with respect to the fine pitch error is solved by searching a fractional pitch by spectral analysis-by-synthesis.

According to the pitch estimation method according to spectral analysis-by-synthesis, the estimated pitch $T^*$ can be obtained by minimizing the error amount $\zeta(T)$ with respect to a given magnitude spectrum $|S(\omega)|$.

$$\zeta(T) = \frac{\int_{o}^{\pi} (|S(\omega)| - |S(\omega; T)|)^2 d\omega}{B(T)\int_0^{\pi} |S(\omega)|^2 d\omega} \quad \text{[EQUATION 1]}$$

$$T^* = \arg\min \{\zeta(T)\} \quad \text{[EQUATION 2]}$$

wherein, $|S(\omega,T)|$ and $B(T)$ are the magnitude spectrum synthesized from the respective pitch candidates T in a predetermined pitch area and a biasing value of the error amount, respectively.

According to spectral analysis-by-synthesis, a correct pitch estimation can be performed as shown in FIG. 2B with respect to an input voice having a long pitch section as shown in FIG. 2A (the circled portion indicates the position of the estimated pitch). However, as shown in FIG. 3B, it is difficult to correctly estimate the pitch of a voice having a short pitch section and a considerably high period, as shown in FIG. 3A, since errors are similar in the integer multiples of the pitch. Therefore, pitch estimation by conventional spectral analysis-by-synthesis is very likely to cause the gross pitch error and to deteriorate the quality of the restored voice.

In order to overcome this problem, a pitch tracking method is used in the MBE vocoder employing conventional spectral analysis-by-synthesis. However, since the pitch tracking method requires a long look ahead (in general, 80 ms), it is difficult to use the conventional MBE vocoder as the low-delay encoder.

SUMMARY OF THE INVENTION

To solve the above problem(s), it is an objective of the present invention to provide a pitch estimation method for a low-delay multiband excitation vocoder by which it is possible to remove a gross pitch error within a short delay time without using a pitch tracking method in order to improve speech quality.

To achieve the above objective, there is provided a pitch determining method for a low-delay multiband excitation vocoder, comprising the steps of (a) obtaining a synthesized magnitude spectrum and a biasing value of the error amount with respect to respective pitch candidates in a predetermined pitch area from an input voice magnitude spectrum and obtaining the error amount $\zeta(T)$ with respect to the respective pitch candidates T, (b) obtaining a weighted function $W(T)$ with respect to the respective pitch candidates, (c) obtaining a weighted error amount $\zeta_W(T)$ with respect to the respective pitch candidates T by multiplying the error amount $\zeta(T)$ obtained in the step (a) with the weighted function $W(T)$ obtained in the step (b), and (d) determining the candidate pitch having the minimum error amount in the weighted error amount $\zeta_W(T)$ with respect to the respective pitch candidates Tobtained in the step (c) to be an estimated pitch.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Hereinafter, the present invention will be described in detail with reference to the attached drawings.

In the present invention, a normalized spectral covariance is provided in order to amend the spectral analysis-by-synthesis according to the present invention. The normalized spectral covariance C(T) from the respective pitch candidates T in a predetermined pitch area is defined as follows.

$$C(T) = \frac{\int_0^{\pi-\omega_T} E(\omega)E(\omega+\omega_T)d\omega}{\sqrt{\int_0^{\pi-\omega_T} E(\omega)^2 d\omega \int_0^{\pi-\omega_T} E(\omega+\omega_T)^2 d\omega}} \quad \text{[EQUATION 3]}$$

wherein, $\omega_T = 2\pi/T$ and $E(\omega)$ is a spectrum modified so that the average of the excitation spectrum becomes 0.

The modified spectrum $E(\omega)$ is obtained as follows.

$$E(\omega) = |E(\omega)| - \frac{1}{\pi}\int_0^{\pi} |E(\bar{\omega})| d\bar{\omega}, \quad \text{for } \omega \in [0, \pi] \quad \text{[EQUATION 4]}$$

The excitation spectrum $|E(\omega)|$ included in the above Equation 4 is obtained by removing the influence of a spectral envelope $|A(\omega)|$ from the input voice magnitude spectrum $|S(\omega)|$. Namely, $|E(\omega)| = |S(\omega)|/|A(\omega)|$.

Figure 3A:
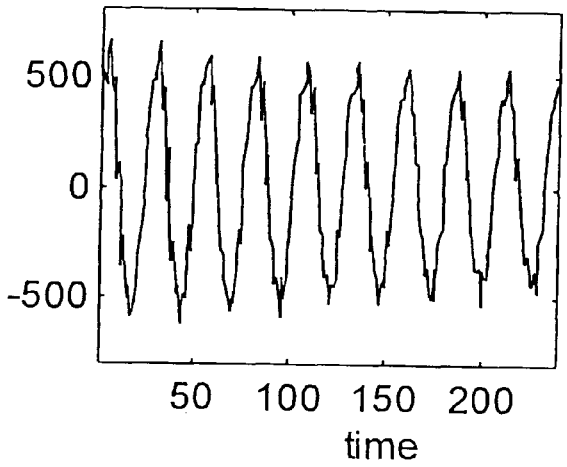
FIG. 3A shows an example of the waveform of a female voice in a temporal area having a short pitch section.
Figure 3B:
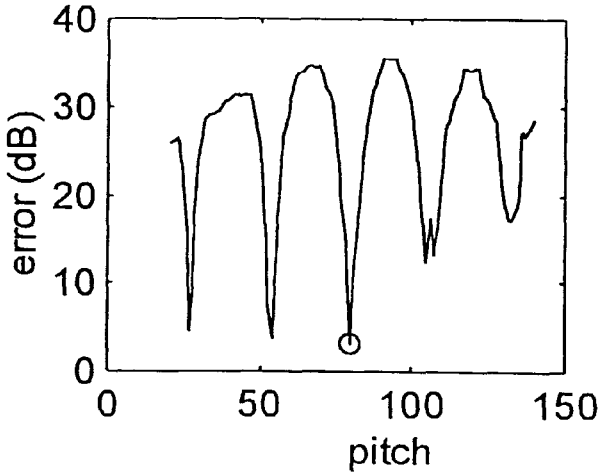
FIG. 3B shows the error amount according to conventional spectral analysis-by-synthesis with respect to the voice waveform shown in FIG. 3A.
Figure 3C:
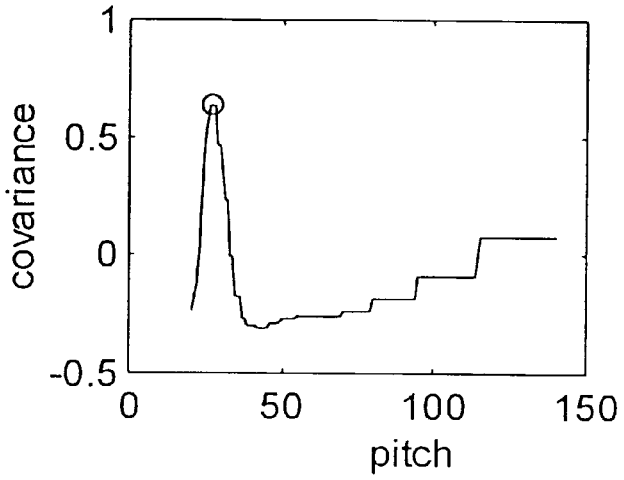
FIG. 3C shows a normalized spectral covariance with respect to the voice waveform shown in FIG. 3A.

The normalized spectral covariance according to a predetermined pitch area is shown in FIG. 3C with respect to the input voice signal as shown in FIG. 3A. According to FIG. 3C, the normalized spectral covariance value is considerably high in a pitch. Therefore, the normalized spectral covariance is very useful to removing the gross pitch error.

Figure 2A:
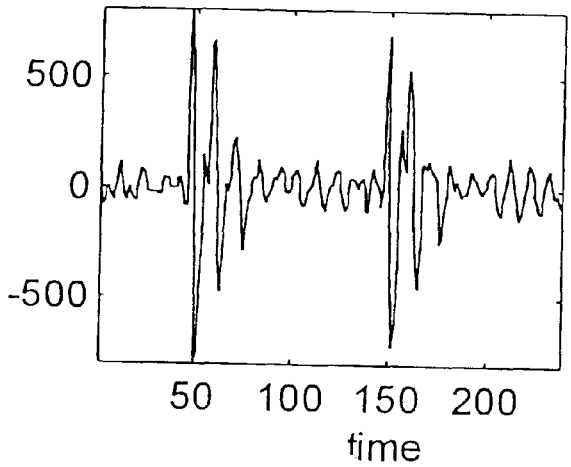
FIG. 2A shows an example of the waveform of a male voice in a temporal area having a long pitch section.
Figure 2B:
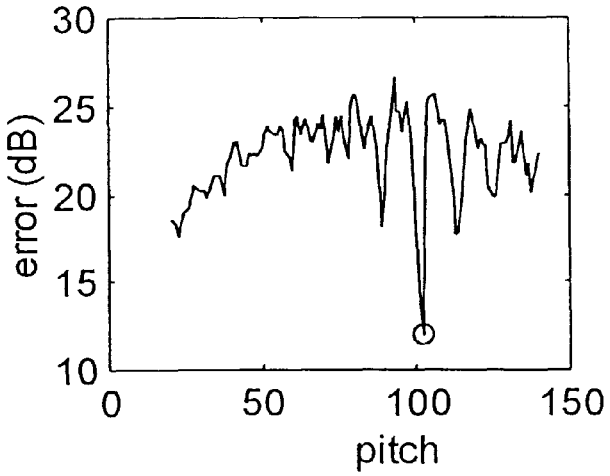
FIG. 2B shows the error amount by conventional spectral analysis-by-synthesis with respect to the voice waveform shown in FIG. 2A.
Figure 2C:
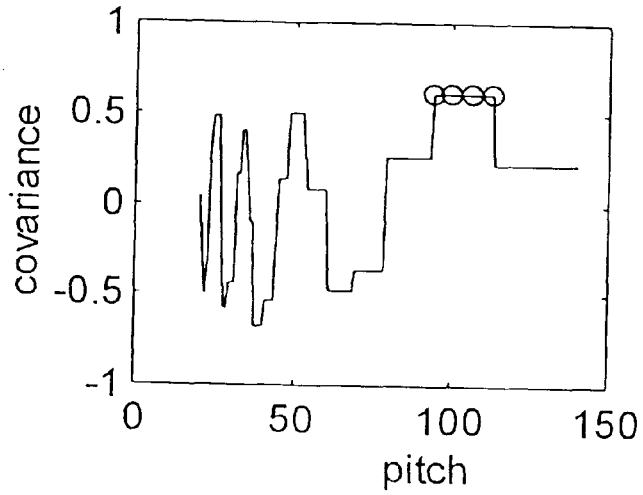
FIG. 2C shows a normalized spectral covariance with respect to the voice waveform shown in FIG. 2A.

However, it is difficult to determine the estimated pitch by the normalized spectral covariance only. As shown in FIG. 2C, the pitch resolution is very low and the value of the covariance is very high even in an integer division pitch.

Therefore, the normalized covariance method cannot be independently used for pitch estimation and must be combined with another pitch estimation method.

In order to remove the gross pitch error and to obtain the pitch of the high resolution, a weighted spectral analysis-by-synthesis method according to the present invention is defined by combining the conventional spectral analysis-by synthesis method with the normalized spectral covariance method. To do so, the normalized spectral covariance C(T) is converted into a weighted function W(T) as follows.

$$W(T) = \frac{(1 - C(T))}{2} \quad \text{[EQUATION 5]}$$

The weighted error amount $\zeta_W(T)$ is defined as follows by combining the error amount $\zeta(T)$ obtained by the Equation 1 with the weighted function W(T) obtained by the Equation 5.

$$\zeta_W(T) = \zeta(T)W(T) \quad \text{[EQUATION 6]}$$

Figure 2D:
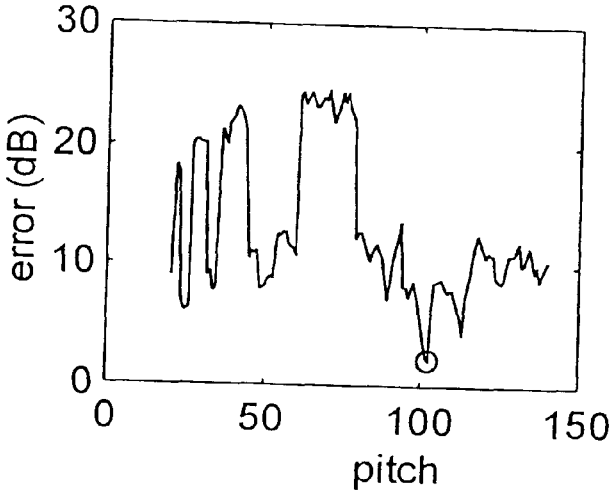
FIG. 2D shows the weighted error amount according to the present invention with respect to the voice waveform shown in FIG. 2A.
Figure 3D:
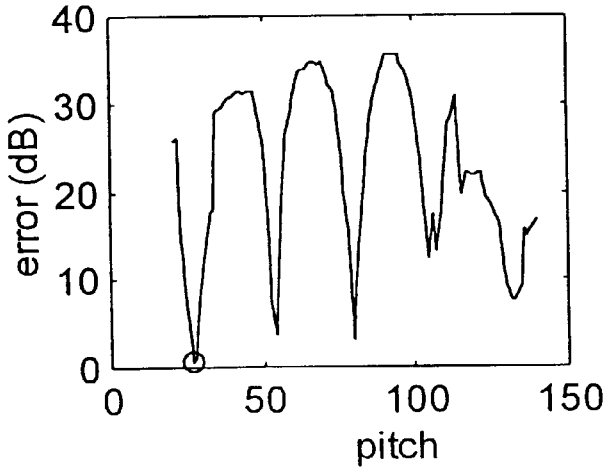
FIG. 3D shows the weighted error amount according to the present invention with respect to the voice waveform shown in FIG. 3A.

In the above Equation 6, $\zeta(T)$ heightens the pitch resolution and W(T) removes the gross pitch error in the error amount $\zeta_W(T)$;

In FIGS. 2D and 3D, the pitch is correctly estimated by the weighted spectral analysis-by synthesis method.

Figure 1:
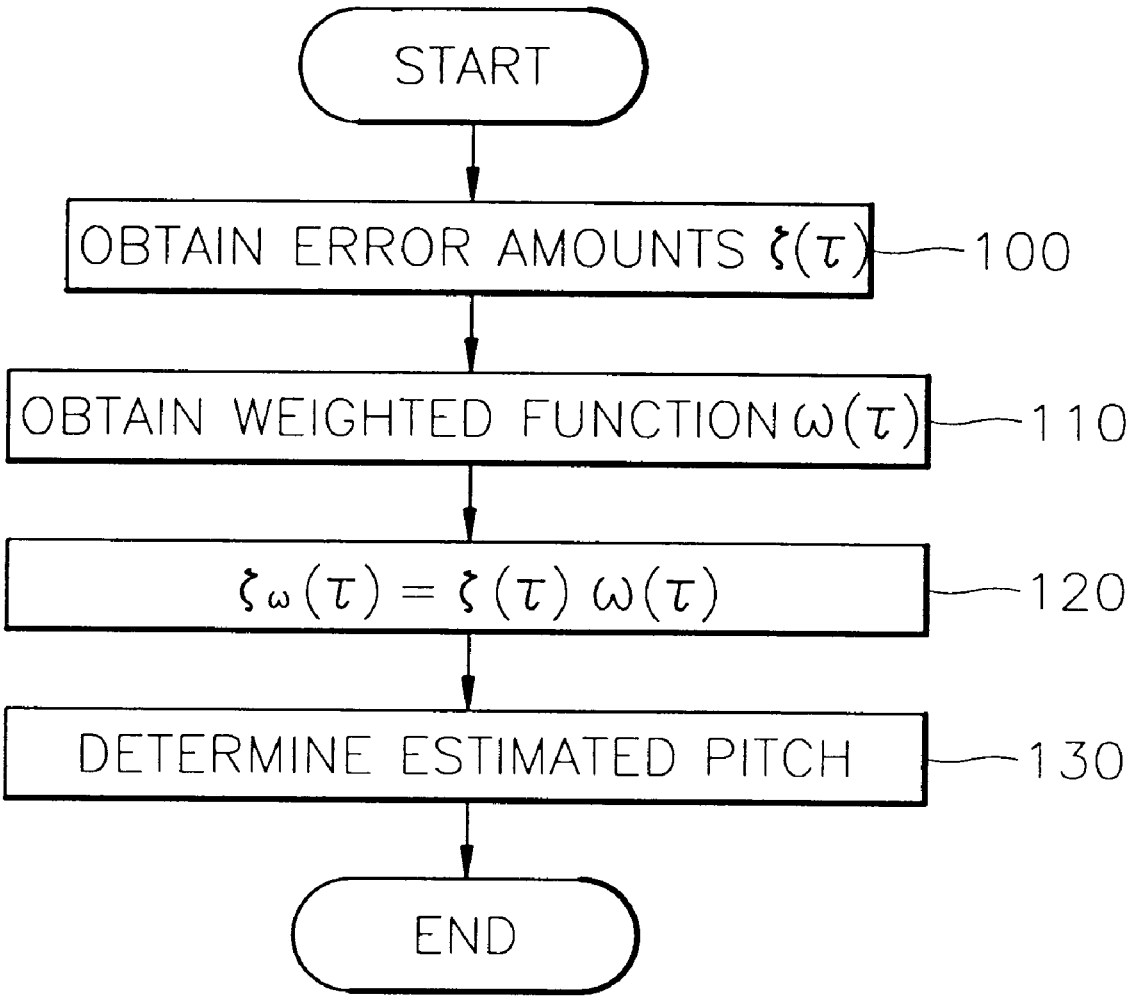
FIG. 1 is a flow chart showing a pitch estimation process in a multiband excitation vocoder according to the present invention.

According to FIG. 1, a process of estimating the pitch in the multiband excitation vocoder according to the present invention is as follows.

First, a synthesized magnitude spectrum and a biasing value of the error amount with the respective pitch candidates in a predetermined pitch area in the input voice magnitude spectrum are obtained and the error amount $\zeta(T)$ with respect to the respective pitch candidates T in a predetermined pitch area is obtained by the Equation 1 (step 100).

The weighted value W(T) with respect to the respective pitch candidates T is obtained by the Equation 5 (step 110).

The weighted error amount $\zeta_W(T)$ with respect to the respective pitch T is obtained by the Equation 6 (step 120).

The candidate pitch having a minimum error amount in the weighted error amount $\zeta_W(T)$ with respect to the respective pitch candidates T obtained in the step 120 is determined as the estimated pitch (step 130).

Figure 4A:
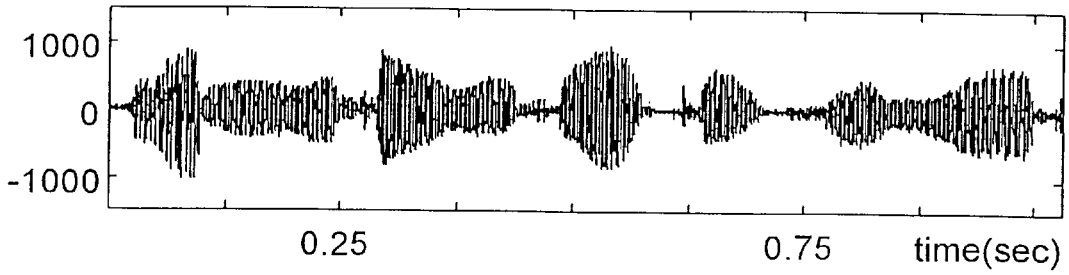
FIG. 4A shows an example of the waveform of a Korean female in a temporal area.
Figure 4B:
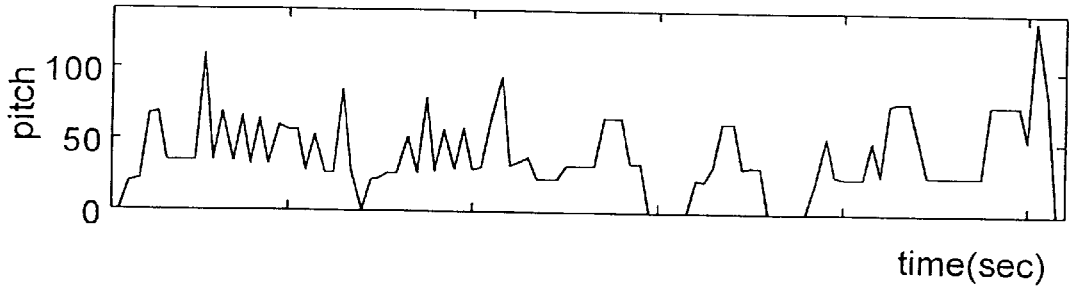
FIG. 4B shows a pitch outline by conventional spectral analysis-by-synthesis with respect to the voice waveform shown in FIG. 4A.
Figure 4C:
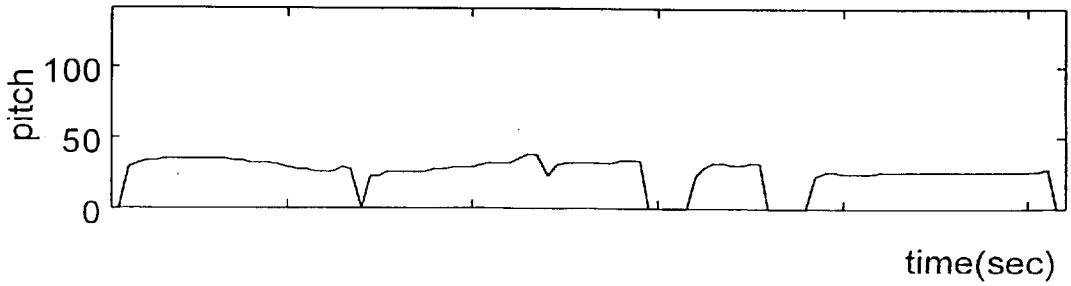
FIG. 4C shows a pitch outline according to the present invention with respect to the voice waveform shown in FIG. 4A.

FIGS. 4A through 4C show a pitch outline according to the conventional spectral analysis-by-synthesis method and a pitch outline according to the present invention, with respect to a female voice made for one second. When the above drawings are compared with each other, it is noted that the gross pitch error is often caused by the conventional method and that there is no gross pitch error according to the present invention.

According to the present invention, it is possible to obtain high speech quality due to a short delay time since it is possible to remove the gross pitch error without using the pitch tracking method in the vocoder of the multiband excitation method.

What is claimed is:

1. A pitch determining method for a low-delay multiband excitation vocoder, comprising the steps of:

(a) obtaining a synthesized magnitude spectrum and a biasing value of the error amount with respect to respective pitch candidates in a predetermined pitch area from an input voice magnitude spectrum and obtaining the error amount $\zeta(T)$ with respect to the respective pitch candidates T;

(b) obtaining a weighted function W(T) with respect to the respective pitch candidates;

(c) obtaining a weighted error amount $\zeta_W(T)$ with respect to the respective pitch candidates T by multiplying the error amount $\zeta(T)$ obtained in the step (a) with the weighted function W(T) obtained in the step (b);

(d) determining the candidate pitch having the minimum error amount in the weighted error amount $\zeta_W(T)$ with respect to the respective pitch candidates T obtained in the step (c) to be an estimated pitch; and (e) removing said minimum error amount without using a pitch tracking method.

2. The method of claim 1, wherein the error amount $\zeta(T)$ with respect to the respective pitch candidates is obtained by the following Equation in the step $$\zeta(T) = \frac{\int_{o}^{\pi} (|S(\omega)| - |S(\omega; T)|)^2 d\omega}{B(T)\int_0^{\pi} |S(\omega)|^2 d\omega}$$

wherein, $|S(\omega)|$,$|S(\omega;T)|$, and $B(T)$ are an input voice magnitude spectrum, a magnitude spectrum synthesized from the respective pitch candidates T, and a biasing value of the error amount with respect to the respective pitch candidates T, respectively.

3. The method of claim 1, wherein the weighted function W(T) with respect to the respective pitch candidates T is obtained by the following Equation in the step (b)

$$W(T) = \frac{(1 - C(T))}{2}$$

wherein, C(T) is a spectral covariance with respect to the respective pitch candidates T.

4. The method of claim 3, wherein the spectral covariance C(T) with respect to the respective pitch candidates T is obtained by the following Equation $$C(T) = \frac{\int_0^{\pi-\omega_T} E(\omega)E(\omega + \omega_T)d\omega}{\sqrt{\int_0^{\pi-\omega_T} (E(\omega))^2 d\omega \int_0^{\pi-\omega_T} (E(\omega + \omega_T))^2 d\omega}}$$

wherein, $\omega_T = 2\pi/T$ and $E(\omega)$ is a spectrum modified so that the average of the excitation spectrum is 0.

5. The method of claim 4, wherein the modified spectrum $E(\omega)$ is obtained by the following Equation $$E(\omega) = |E(\omega)| - \frac{1}{\pi}\int_0^{\pi} |E(\overline{\omega})| d\overline{\omega}, \quad \text{for } \omega \in [0, \pi]$$

wherein, $E(\omega)$ is an excitation spectrum obtained by removing the influence as of a spectral envelope $|A(\omega)|$ from the input voice magnitude spectrum $|S(\omega)|$.

* * * * *